US008733505B2

(12) United States Patent
Paquet et al.

(10) Patent No.: US 8,733,505 B2
(45) Date of Patent: May 27, 2014

(54) TWO PIECE CLIMBER APPARATUS

(76) Inventors: Jules P. Paquet, Fullerton, CA (US); Matthew Monnig, Fullerton, CA (US); Edward Jones, Placentia, CA (US)

( * ) Notice: Subject to any disclaimer, the term of this patent is extended or adjusted under 35 U.S.C. 154(b) by 130 days.

(21) Appl. No.: 12/938,324

(22) Filed: Nov. 2, 2010

(65) Prior Publication Data

US 2011/0100751 A1 May 5, 2011

Related U.S. Application Data

(60) Provisional application No. 61/258,166, filed on Nov. 4, 2009.

(51) Int. Cl.
*A63B 27/00* (2006.01)

(52) U.S. Cl.
USPC ..... 182/221; 182/134; 403/302; 403/306; 403/294

(58) Field of Classification Search
USPC ..... 182/90, 92, 221, 134; 403/302, 306, 403/294, 364, 408.1
See application file for complete search history.

(56) References Cited

U.S. PATENT DOCUMENTS 613,007 A * 10/1898 Howard ..... 182/221
1,174,347 A * 3/1916 Ranney ..... 182/221
1,427,030 A * 8/1922 Stephens et al. ..... 482/75
1,505,360 A * 8/1924 Lowery ..... 182/134
1,983,526 A * 12/1934 Bailey ..... 182/221
2,052,705 A * 9/1936 Glass ..... 294/26
2,235,437 A * 3/1941 Lawson ..... 72/341
2,262,394 A * 11/1941 Evans ..... 182/46
2,284,190 A * 5/1942 Evans ..... 182/46
2,297,136 A * 9/1942 Detering ..... 182/221
2,391,810 A * 12/1945 Webber ..... 182/221
2,484,181 A 4/1948 Munger et al.
2,807,400 A * 9/1957 Rolfsmeyer ..... 182/134
3,867,998 A * 2/1975 Joseph ..... 182/221
4,368,801 A * 1/1983 Lewis ..... 182/134
4,402,385 A * 9/1983 Buche ..... 182/91
4,530,420 A * 7/1985 Hobbs ..... 182/221
4,753,447 A * 6/1988 Hall ..... 280/163
5,016,734 A * 5/1991 Greenway ..... 182/221
5,615,445 A * 4/1997 Kelsay et al. ..... 15/245.1
5,853,067 A * 12/1998 Cutler ..... 182/221
D450,986 S * 11/2001 Harvanek ..... D8/45
6,845,846 B1 * 1/2005 Gragnano ..... 182/134

* cited by examiner

*Primary Examiner* — Charles A Fox
*Assistant Examiner* — Kristine Florio
(74) *Attorney, Agent, or Firm* — Fulwilder Patton LLP

(57) ABSTRACT

A two piece climber includes an upper calf bracket portion and a lower "J" shaped stirrup bracket portion permanently or removably interchangeably connected together. The lower "J" shaped stirrup bracket portion includes an upper slotted portion for receiving the lower portion of the upper calf bracket portion. The lower "J" shaped stirrup bracket portion also includes a bottom grooved or knurled grip portion to provide traction for an arborist walking across branches.

4 Claims, 3 Drawing Sheets

TWO PIECE CLIMBER APPARATUS

This application is based upon Provisional Application No. 61/258,166, filed Oct. 4, 2009, the entire contents of which are incorporated herein by reference.

BACKGROUND OF THE INVENTION

The present invention relates to a tree or pole climber commonly used by arborists or utility workers, and more particularly relates to a two piece tree or pole climber having an upper calf bracket portion and a lower "J" shaped stirrup bracket portion, with the upper and lower portions configured to be interchangeably connected together.

Tree or pole climbers typically are formed from a single piece of metal to have an upper calf bracket portion and a lower "J" shaped stirrup or hook shaped bracket portion, with the upper calf bracket portion being configured to be strapped to a user's calf over a boot, with appropriate padding or shielding, and the lower "J" shaped stirrup or hook shaped bracket portion being configured to be strapped to the user's foot. The lower "J" shaped stirrup or hook shaped bracket portion is also typically configured to have one or more spurs or gaffs bolted to the lower "J" shaped stirrup or hook shaped bracket portion. The upper and lower bracket portions each can be formed with different angles and configurations to suit the particular user or the intended use of the climber. Such climbers are also typically formed as one piece of a variety of materials, such as steel, aluminum or titanium, for example, with each material having desirable properties of strength, durability and weight. It would be desirable to provide a climber formed of an upper calf bracket portion and a lower "J" shaped stirrup bracket portion separate from the upper calf bracket portion, with the upper and lower portions configured to be interchangeably connected together, such that the upper calf bracket portion and lower bracket portion can be formed with different angles and configurations, and of different materials, and assembled together as desired.

It would also be desirable to provide a grip portion on a bottom surface the lower "J" shaped stirrup bracket portion of the climber, to give an arborist some traction when walking across branches. The present invention meets these and other needs.

SUMMARY OF THE INVENTION

Briefly, and in general terms, the present invention provides for a two piece tree or pole climber having a first or upper calf bracket portion, and a second or lower "J" shaped stirrup bracket portion with a grooved grip portion on a bottom surface the lower "J" shaped stirrup bracket portion. The upper calf bracket portion and the lower "J" shaped stirrup bracket portion are configured to be either permanently or removably interchangeably connected together, and the grooved grip portion on a bottom surface the lower "J" shaped stirrup bracket portion of the climber also functions as a wear strip, indicating that it is time to replace the climber when the grooves exhibit a sufficient degree of wear.

Accordingly, the present invention provides for a two piece tree or pole climber having an upper calf bracket portion and a separate lower "J" shaped stirrup bracket portion configured to be either permanently or removably interchangeably connected together. The upper calf bracket portion includes an upper portion having a surface defining a plurality of bolt holes or apertures for mounting of an upper pad and calf strap by fasteners, and a lower portion having a surface defining a plurality of bolt holes or apertures for mounting of the lower "J" shaped stirrup bracket portion to the upper calf bracket portion.

The lower "J" shaped stirrup bracket portion includes an upper slotted or forked portion including two upper plate portions spaced apart to form an upper slot for receiving the lower portion of the upper calf bracket portion, with each of the two upper plate portions having surfaces defining a plurality of bolt holes or apertures corresponding to and aligned with each other and the plurality of bolt holes or apertures of the lower portion of the upper calf bracket portion, for permanently or removably mounting the lower portion of the upper calf bracket portion to the upper portion of the lower "J" shaped stirrup bracket portion. The upper calf bracket portion and the lower "J" shaped stirrup bracket portion are configured to be either permanently or removably interchangeably connected together, so that the upper calf bracket portion and lower "J" shaped stirrup bracket portion can be formed separately with desired angles and configurations, and of different materials, such as steel, aluminum or titanium, for example, for optimizing and customizing strength and weight features of the climber, and assembled together as desired.

The lower "J" shaped stirrup bracket portion also includes a bottom grooved, ridged or knurled grip portion with a bottom surface defining a first plurality of grooves or ridges extending parallel to each other in a first direction, and a second plurality of grooves or ridges extending parallel to each other in a second direction and intersecting the first plurality of grooves. The grooved, ridged or knurled grip portion on a bottom surface the lower "J" shaped stirrup bracket portion of the climber provides fraction for an arborist walking across branches, and also functions as a wear strip, indicating that it is time to replace the climber when the grooves or ridges exhibit a sufficient degree of wear.

These and other aspects and advantages of the invention will become apparent from the following detailed description and the accompanying drawings, which illustrate by way of example the features of the invention.

DETAILED DESCRIPTION OF THE PREFERRED EMBODIMENTS

Figure 1:
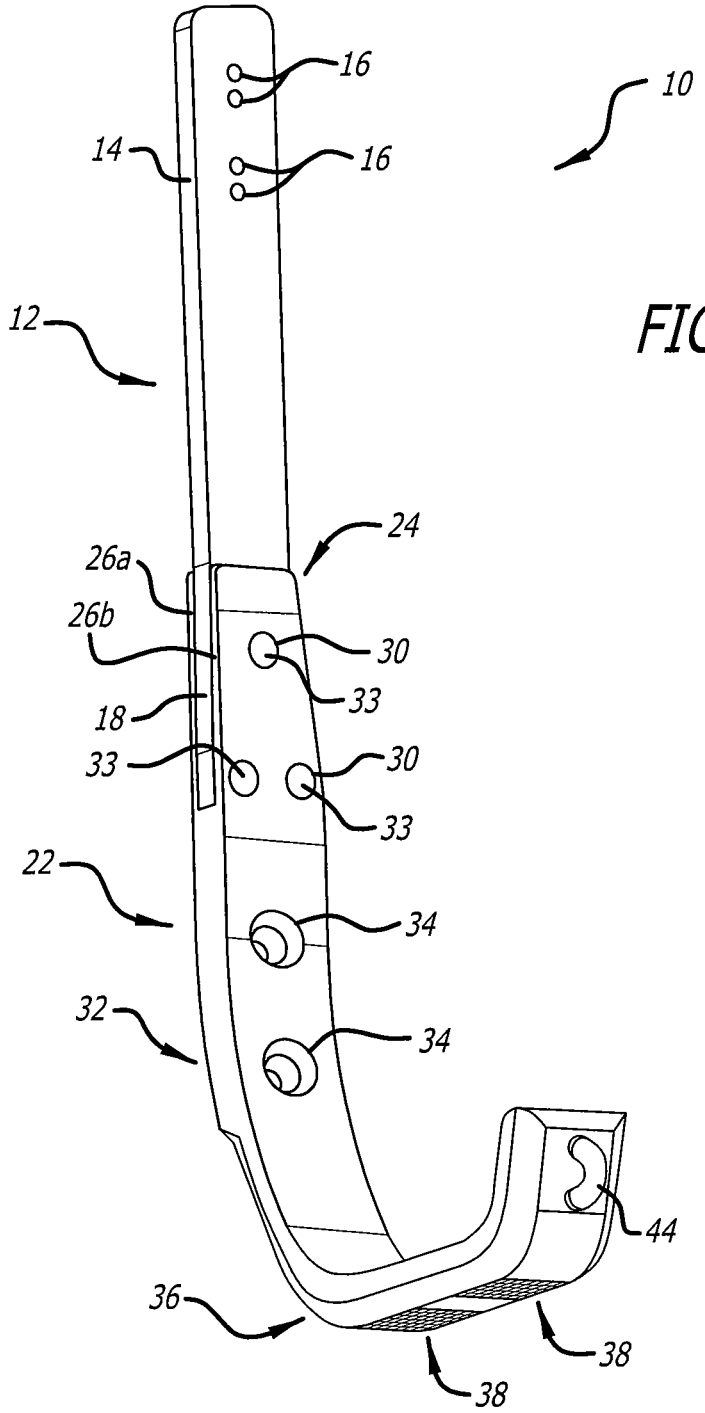
FIG. 1 is a side perspective view of the two piece climber shown in an assembled configuration, according to the present invention.
Figure 2:
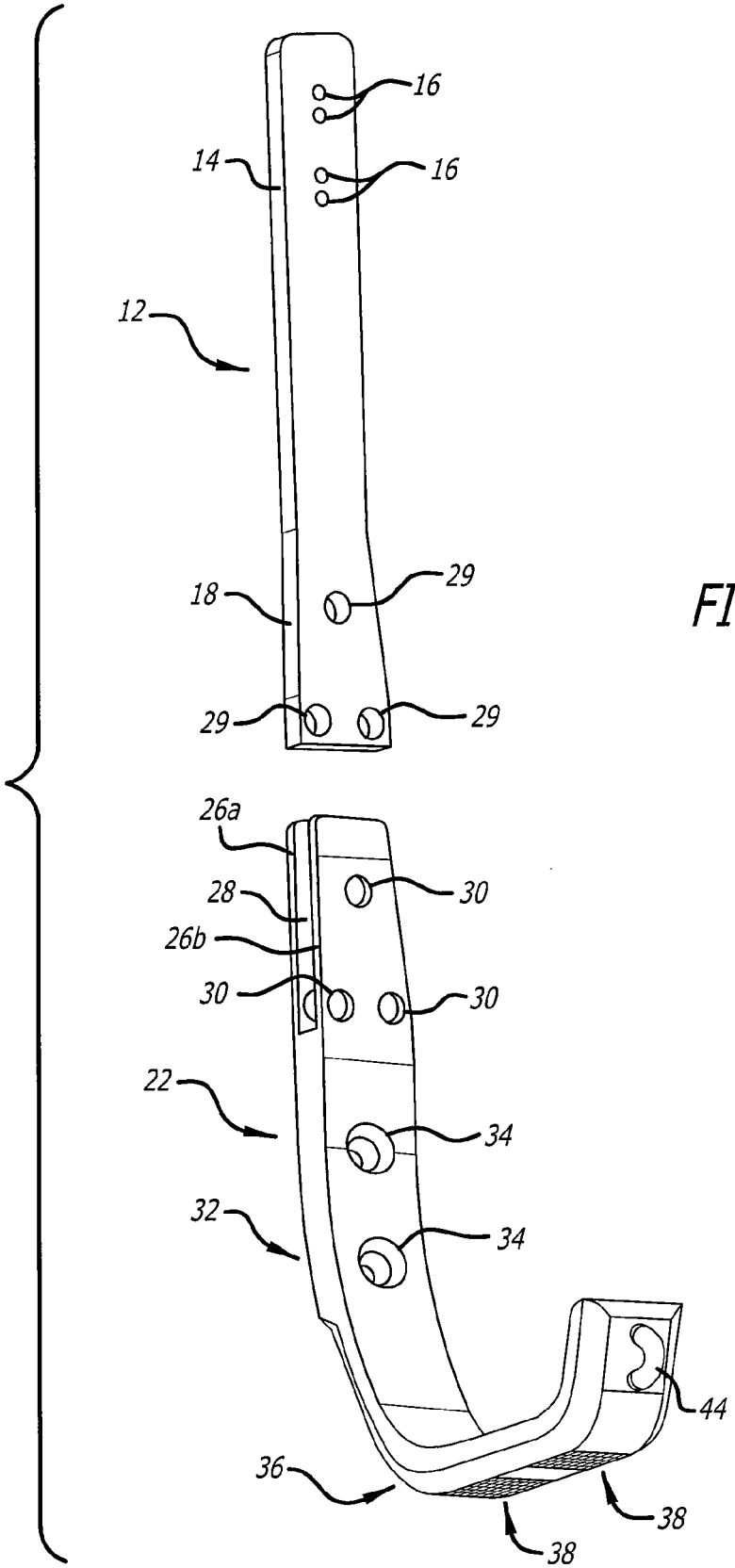
FIG. 2 is a side perspective exploded view of the two piece climber shown in a disassembled configuration, according to the present invention.

Referring to the drawings, which are provided by way of example, and not by way of limitation, the present invention provides for a two piece tree or pole climber 10 having a first or upper calf bracket portion 12 including an upper portion 14 having a surface defining a plurality of bolt holes or apertures 16 for mounting of an upper pad and calf strap (not shown) by fasteners (not shown), such as bolts or rivets, for example. Referring to FIG. 2, the upper calf bracket portion also includes a lower portion 18 having a surface defining a plurality of bolt holes or apertures 29 for mounting of a separate second or lower "J" shaped stirrup bracket portion 22 to the upper calf bracket portion.

The lower "J" shaped stirrup bracket portion includes an upper slotted or forked portion 24 including two upper plate portions 26*a*, 26*b* spaced apart to form an upper slot 28 for receiving the lower portion of the upper calf bracket portion in tongue and groove fashion, with each of the two upper plate portions having surfaces defining a plurality of bolt holes or apertures 30, with the bolt holes or apertures of one plate aligned with the corresponding bolt holes or apertures in the other plate, and with the bolt holes or apertures of both plates aligned with a corresponding matching plurality of bolt holes or apertures 29 of the lower portion of the upper calf bracket portion when it is received in the upper slot, for either permanently or removably interchangeably mounting the lower portion of the upper calf bracket portion to the upper portion of the lower "J" shaped stirrup bracket portion by fasteners 33, such as bolts or rivets, for example.

The upper calf bracket portion and the lower "J" shaped stirrup bracket portion are configured to be interchangeably permanently or removably connected together, so that the upper calf bracket portion and lower bracket portion can be formed separately with desired angles and configurations, and of different materials, such as steel, aluminum or titanium, for example, for optimizing and customizing strength and weight features of the climber, and assembled together as desired. The lower "J" shaped stirrup bracket portion also includes a middle portion 32 with a surface defining a plurality of countersunk holes 34 for receiving fasteners (not shown), such as bolts or rivets, for example, for mounting of one or more spurs or gaffs (not shown) to the lower "J" shaped stirrup bracket portion, and typically facing away from a lower stirrup portion of the lower "J" shaped stirrup bracket portion.

Figure 3:
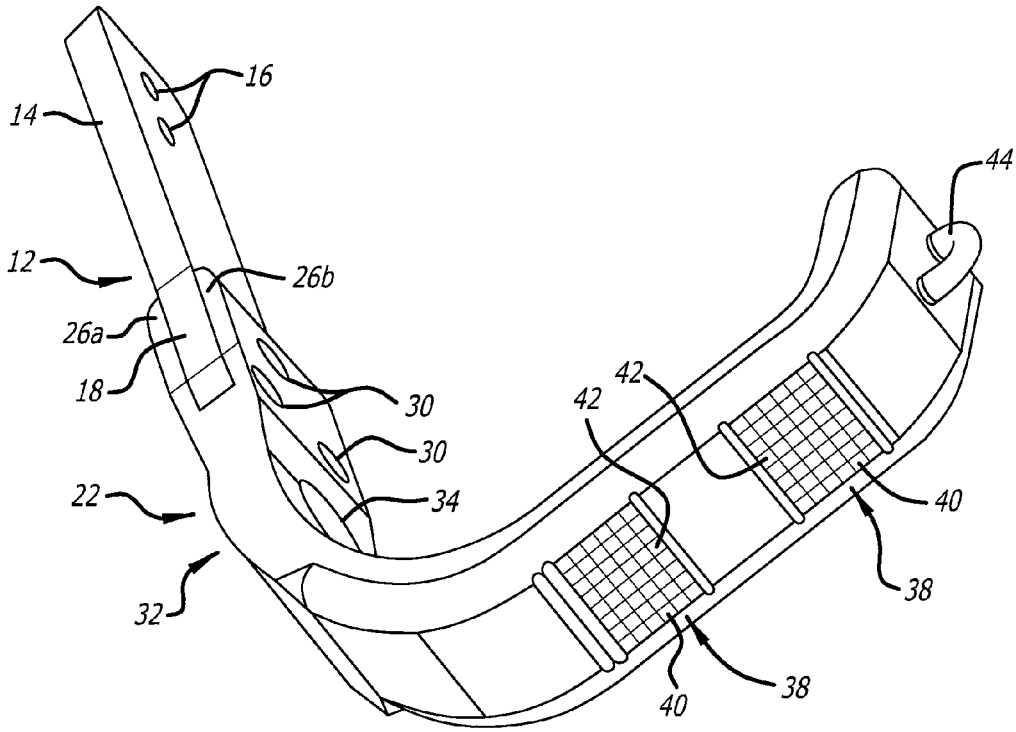
FIG. 3 is a bottom perspective view of the two piece climber shown in an assembled configuration, showing the bottom grooved or knurled grip portion.

The lower "J" shaped stirrup bracket portion also includes a bottom curved hook or stirrup portion 36 with at least one bottom grooved, ridged or knurled grip portion 38 with a bottom surface defining a first plurality of grooves or ridges 40 extending parallel to each other in a first direction, and a second plurality of grooves or ridges 42 extending parallel to each other in a second direction intersecting the first plurality of grooves, as shown in FIG. 3. The grooved or knurled grip portion on the bottom surface the lower "J" shaped stirrup bracket portion of the climber provides traction for an arborist walking across branches, and also functions as a wear strip, indicating that it is time to replace the climber when the grooves exhibit a sufficient degree of wear. The lower "J" shaped stirrup bracket portion also preferably includes a loop 44 on a lower end portion for receiving and mounting of a lower strap (not shown) to be threaded around a boot of a user.

It will be apparent from the foregoing that while particular forms of the invention have been illustrated and described, various modifications can be made without departing from the spirit and scope of the invention. Accordingly, it is not intended that the invention be limited, except as by the appended claims.

We claim:

1. A two piece climber, comprising:

a first calf bracket portion including an upper portion and a lower portion, said upper portion of said first calf bracket portion having a surface defining a plurality of bolt holes or apertures, and said lower portion of said first calf bracket portion having a surface defining a triangular configuration of three apertures; and a second stirrup bracket portion, said second stirrup bracket portion including an upper forked portion including a first upper plate portion and a second upper plate portion, said first and second upper plate portions being spaced apart to form an upper slot, said lower portion of said first calf bracket portion being configured to be received in said upper slot of said upper forked portion, said first upper plate portion having a surface defining a first triangular configuration of three apertures and said second upper plate portion having a surface defining a second triangular configuration of three apertures corresponding to and aligned with said first triangular configuration of three apertures of said first upper plate portion, respectively, and said first and second triangular configurations of three apertures of said first and second plate portions being aligned with said triangular configuration of three apertures of said lower portion of said upper calf bracket portion, respectively, when said lower portion of the first calf bracket portion is received in the upper forked portion of the second stirrup bracket portion, said lower portion of said first calf bracket portion being mounted to said second stirrup bracket portion by at least two fasteners inserted through said first and second triangular configurations of three apertures of said first and second plate portions aligned with said triangular configuration of three apertures of said lower portion of said upper calf bracket portion such that said first calf bracket portion and said second stirrup bracket portion can be selectively connected at a plurality of different angles with respect to each other, said second stirrup bracket portion including a bottom grip portion with a bottom surface defining a first plurality of grooves extending parallel to each other in a first direction, and a second plurality of grooves extending parallel to each other in a second direction and intersecting said first plurality of grooves, and said second stirrup bracket portion being configured to be connected to said first calf bracket portion in a tongue and groove configuration.

2. The two piece climber of claim 1, wherein said first calf bracket portion and said second stirrup bracket portion are configured to be removably interchangeably connected together.

3. The two piece climber of claim 1, wherein said first calf bracket portion and said second stirrup bracket portion are formed separately of different materials.

4. The two piece climber of claim 1, wherein said second stirrup bracket portion is "J" shaped.

* * * * *